United States Patent [19]

Sauder

[11] 3,975,876

[45] Aug. 24, 1976

[54] WOOD FRAME BUILDING WALL

[76] Inventor: Reinhold Sauder, 7315 8 Ave., Regina, Saskatchewan, Canada, S4T 0X2

[22] Filed: Mar. 4, 1975

[21] Appl. No.: 555,272

[52] U.S. Cl. ..... 52/282; 52/593; 52/579; 52/495; 52/270

[51] Int. Cl.[2] ..... E04B 1/00; E04B 5/00

[58] Field of Search ..... 52/270, 272, 274, 282, 52/311, 495, 284, 241, 169, 593, 579; 61/39, 49

[56] References Cited

UNITED STATES PATENTS

| | | | |
|---|---|---|---|
| 1,334,842 | 3/1920 | Corn | 52/495 |
| 2,359,304 | 10/1944 | Davison | 52/274 |
| 2,615,211 | 10/1952 | Gardner | 52/495 |
| 3,296,756 | 1/1967 | Wade | 52/270 |
| 3,299,594 | 1/1967 | Kellert | 52/270 |
| 3,423,894 | 1/1969 | Richardson | 52/495 |
| 3,820,343 | 6/1974 | Morren | 52/284 |

*Primary Examiner*—Ernest R. Purser
*Assistant Examiner*—Robert Farber
*Attorney, Agent, or Firm*—Cushman, Darby & Cushman

[57] ABSTRACT

A wood frame building wall of the type having panel members inserted in grooves provided in sills, upright posts and in top plates of the wall frame. According to the invention, the sills and the top plates are broader than the sides of the square cross-section of the upright posts, mutually adjacent posts being located alternately at edges of the sills and top plates, whereby the mutual orientation of wood grain of timber pieces forming the frame results in an extremely strong and yet light-weight wall structure. The wood frame is made of heavy timber pieces which require minimum machining and are arranged so as to enable re-use of the timber pieces after eventual disassembly of the building wall.

10 Claims, 8 Drawing Figures

WOOD FRAME BUILDING WALL

This invention relates to a wood frame structural building and in particular to a peripheral wall assembly for such building. The term "wood frame building" as hereinafter referred to is to be interpreted as meaning that all essential elements of the framing of the building structure, are made from lumber, with possible exception of concrete foundation sills and of fasteners such as nails, bolts, pins or the like, which are normally made of a suitable type of steel.

In wood frame buildings it is common to use dimension lumber milled to standardized size specifications. The presently known and widely used methods of wood construction framing consists of structuring the frame by use of such dimension lumber as 2 inches by 4 inches, 2 inches by 6 inches, 2 inches by 8 inches, 2 inches by 10 inches, 2 inches by 12 inches and rarely such having dimensions as 4 inches by 4 inches and up to 12 inches by 12 inches as posts and/or beams. Such framing members are then secured or fastened one to the other by means of iron or steel nails or other similar fasteners driven into or through the wood. The frame is then reinforced and strengthened by one or more layers of additional building materials overlaying the outside of the frame and secured to it by nails or by other suitable means. The inside of the building structure is then also covered by one or more layers of building material again using conventional fasteners.

The conventional methods current today have been in use for a century or more and on close examination are repetitive and cumbersome, time consuming and uneconomical when applied in the process of fabricating, assembling and directing a complete structure. Furthermore, the structural strength attained by these old methods is far from a maximum utilization of the inherent strength of the wood structural and sheathing members employed.

Attempts have been made to solve the above drawbacks, a typical example of such attempt being Canadian Patent 632,306 (Alcock) which discloses a wood frame peripheral wall structure comprising a plurality of interlocked upstanding peripheral frames defined by top plates, bottom plates and spaced upstanding studs extending between the top and bottom plates and a panel formation for each peripheral frame having its edges rabetted into the top and bottom plates and upstanding studs of each frame. The peripheral wall thus defines a structure consisting of four, generally planar sections of the wall defining a generally rectangular figure in plane. While Alcock may have a reduced number of components for providing a peripheral wall, it still suffers from the drawback mentioned above, namely that the inherent strength of the components of the peripheral wall is utilized only to a very limited degree with the result that the peripheral wall has to be further supported by inside partition walls of the building and is unsuitable for buildings having a comparatively large span of free inside space such as halls or the like. It is also known from the art of non-wood structures (e.g. from U.S. Pat. No. 3,820,343 — Morren et al) to provide precast concrete wall members for a sea wall adapted to build a zig-zag shaped wall that is self-supporting. In other words, the advantages of a generally zig-zag structure over conventional, generally planar arrangement are well known. Yet, for some reason or another, they have not been utilized in the art of wood frame buildings to produce light and extremely strong peripheral walls of same.

It is an object of the present invention to provide a peripheral wall structure of a wood-frame building which would combine the features of use of basic lumber components with minimum machining of same and which would at the same time attain the rigidity of peripheral walls by an improved utilization of inherent strength of wooden components of the structure, thus obtaining a lightweight all-wood peripheral wall structure.

The above object is obtained in a peripheral wall assembly according to the present which by a particular mutual arrangement of the orientation of wood grain of used lumber components provides for a surprisingly increased strength of wood-frame peripheral walls.

According to the invention a peripheral wall assembly is provided for a wood-frame building, the assembly comprising a substantially horizontal wall sill member including a top, generally horizontal upper surface and longitudinal, generally vertical outer and inner surfaces parallel with one another, said sill member forming the base of said wall assembly. The assembly further comprises a plurality of upright posts including corner posts and adapted to be detachably but firmly secured to said top surface of the sill, said posts being heavy timber surfaces of generally square cross-section, each of the posts thus having four substantially planar, vertical surfaces; the distance between said two longitudinal surfaces of the sill being greater than the length of sides of said generally square cross-section of the posts; said plurality of upright posts consisting of outer posts and inner posts; said outer posts being secured to said sill with one of their surfaces substantially coincident with said outer surface of said sill, said inner posts being secured to said sill with one of their surfaces substantially coincident with said inner surfaces, said posts being disposed along said sill in a zig-zag fashion; an upper plate having substantially the same shape as the sill and disposed substantially parallel with same, said posts being adapted to be detachably but firmly secured to said upper plates; substantially planar rectangular wall panels; made of fibrous material such as wood; each of said wall panels being maintained in said wall assembly solely by being releasably received with its peripheral edges in grooves provided in side surfaces of two adjacent posts, in the portion of said sill extending between the said posts and in the portion of said upper plate extending between said posts, with the wall panel thus extending between a pair of two adjacent posts, one post of said pair being the outer post, the other post of said pair being the inner post, and between said portions of the sill and of the upper plate.

In another embodiment of the present invention, the wall assembly comprises at least two elongated main sills forming main base of said wall assembly; a plurality of horizontally extending secondary sills made of heavy timber having outer and inner longitudinal, substantially vertical surfaces, and adapted to be firmly but detachably secured to the top of said main sills in a zig-zag fashion; upright main post members including corner post members adapted to be fixedly but removably secured to the top of said secondary sill at points of joints between two adjacent secondary sill, said main post members being made of heavy timber and being of a generally cross-section with two opposite sides of said cross-section being generally parallel with longitudinal axis of said wall assembly; at least two upright intermediate post members of generally square cross-section and made of heavy timber pieces, each of the posts thus having four substantially planar vertical surfaces, adapted to be detachably but firmly secured to the top of said secondary sill between each pair of adjacent alternately disposed main post members; the distance between said outer and inner longitudinal surfaces of the secondary sills being greater than the length of longer sides of said generally square cross-section of the intermediate post members; said intermediate posts consisting of outer posts and inner posts, each of said outer posts being secured to its associated secondary sill with one of its surfaces substantially coincident with said outer surface of said sill, each of said inner posts being secured to its associated secondary sill with one of its surfaces substantially coincident with said inner surface, the intermediate posts thus being disposed on said secondary sill in a zig-zag fashion; generally horizontal secondary upper plates having substantially the same shape as the secondary sills and disposed substantially parallel with same, said main and intermediate post members being adapted to be detachably but firmly secured with their upper ends to said upper plates; two elongated, generally horizontal main upper plates disposed in parallel with one another and made of heavy timber, said main upper plate being arranged to be detachably but firmly secured on top of said secondary upper plates; a plurality of substantially planar, rectangular wall panels; made of fibrous material such as wood; each of said wall panels being maintained in said wall assembly solely by being releasably received with its upright peripheral edges in grooves provided in side surfaces of two adjacent post members, horizontal peripheral edges of each of said panels being releasably received in grooves provided in the portions of said secondary sills and said secondary upper plates extending between said two adjacent post members.

The present invention will now be described in greater detail with reference to the accompanying schematic drawings. In the drawings.

Figure 1:
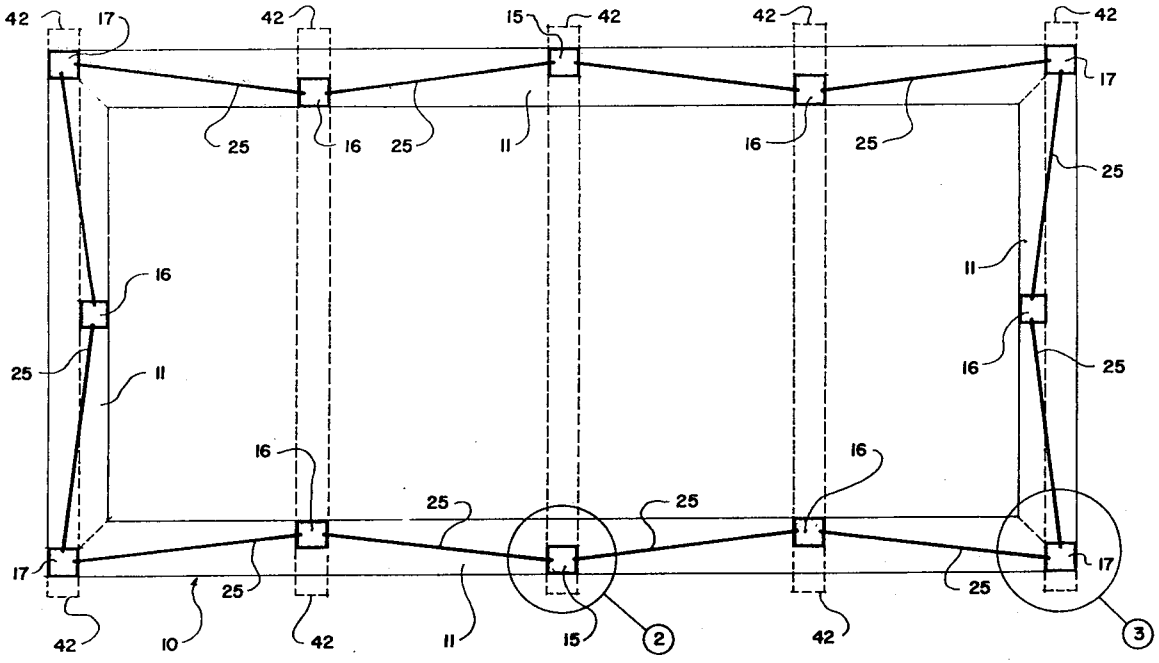
FIG. 1 is a plan view of one embodiment of the present invention, with the posts shown in section.
Figure 4:
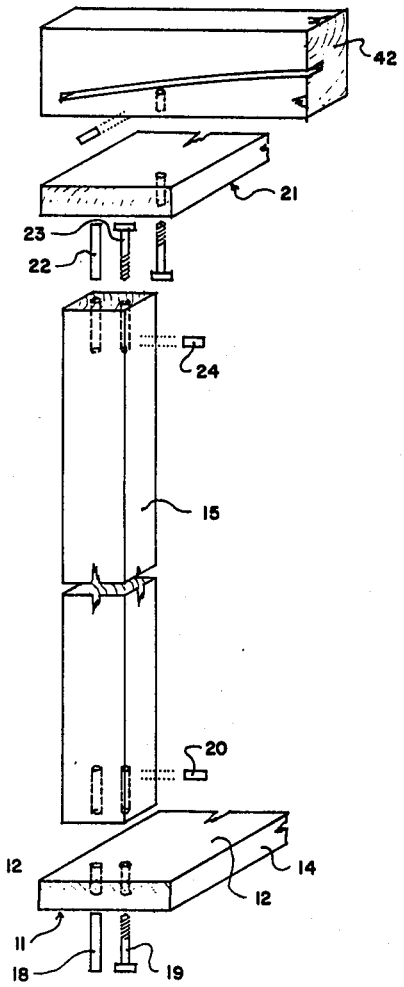
FIG. 4 is a schematic, exploded view in perspective showing one way of fastening of the basic frame components of the present invention.

Turning now to the drawings and particularly to FIG. 1, it will be observed that 10 designates a peripheral wall assembly of a building which is generally rectangular in shape as viewed from top. The structure rests on wall sills 11 defining the above generally rectangular shape. As best seen from FIG. 4, the wall sill 11 is, in the embodiment of FIG. 1, a heavy horizontal timer 3 inches by 12 inches in size. The sill is also referred to as a horizontal wall sill member and has (FIG. 4) a generally horizontal upper surface 12, a generally vertical outer surface 13 and an inner surface 14, which is parallel with said outer surface 13. The sill member 11 forms the base of the wall assembly 10. A plurality of upright posts 15, 16 including corner posts 17 is adapted to be detachably but firmly secured to the top surface 12 of the sill 11 by means of dowel pin 18 and/or a bolt 19 adapted to engage a nut 20 inserted in the post 15 (FIG. 4) at the lower end thereof. The dowel pin or bolt fastener are of well known type and therefore need not be described in greater detail. The posts 15, 16 and 17 are heavy timber pieces of a 6 inch by 6 inch cross-section, each of the post 15–17 thus having four substantially planar, vertical surfaces.

As best seen from FIG. 1, the width of the wall sill 11, or the distance between the outer and inner surfaces 13, 14, is greater then the length of the sides of the cross-section of the posts 15–17, the difference in this particular embodiment amounting to 6 inches (i.e. 12 inches of the width of the sill less 6 inches of the post).

The posts 15–17 can be divided into three groups depending upon their location with respect to the sill 11. Referring to FIG. 1, it will be seen that the posts 15 are each secured to their associated sill 11 in a manner whereby one of the four surfaces of the posts 15 is generally coincident with the outer surface 13 of the sill. The posts 15 can thus also be referred to as outer posts 15. On the other hand, each of the posts 16 has one of its surfaces generally coincident with the inner surface 14 of the sill 11 so that the posts 16 can also be referred to as inner posts 16. It will be observed that from the standpoint this terminology, the corner posts 17 are all outer posts.

Figure 2:
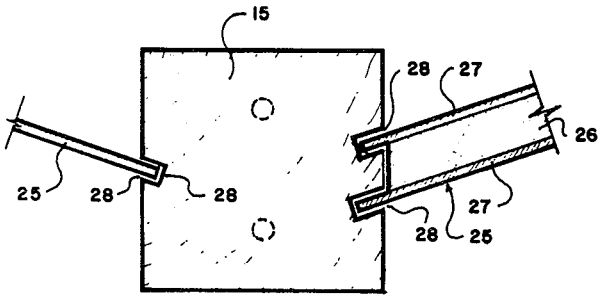
FIG. 2 is a partial perspective view of detail 2 of FIG. 1.
Figure 3:
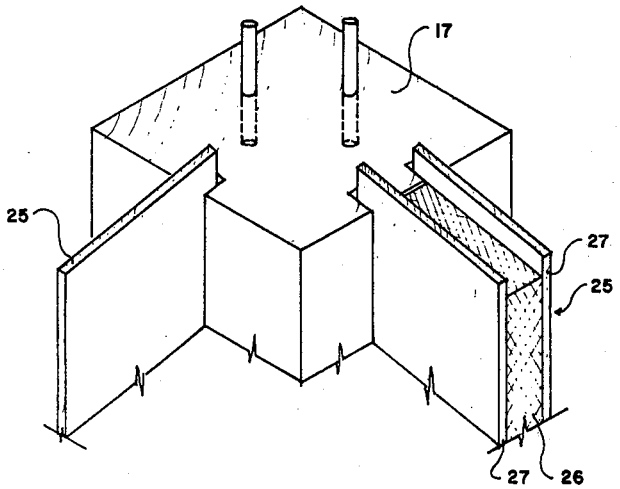
FIG. 3 is a partial perspective view of detail 3 of FIG. 1.

Adapted to be fixedly secured to the top of posts 15–17 is an upper wall plate 21 which is identical in size to the sill 11 and is located parallel with and vertically above the same. The upper plate 21 is secured to the posts 15–17 in a way similar to the joints with the sill 11, i.e. by dowel pins 22 and by bolts 23 and nuts 24 (only one of each shown in FIG. 4). In other words, the posts 15–17 are adapted to be detachably but firmly secured to said upper plate 21. The upper plate 21 supports roof beams 42 and their associated parts (not shown) of the roof structure of the building. As best seen from FIGS. 1, 2, 3 and 5, the assembly further comprises generally planar wood panels 25. With particular reference to FIGS. 2 and 3, it will be seen that the panels 25 can be plain wood or the like panels or they can comprise an insulation layer 26 sandwiched between two surface members 27. The panels 25 for use in connection with the present invention are of a very wide variety and are well known in the art. As they do not by themselves constitute the present invention they need not be described in greater detail. The panels 25 are each received between adjacent posts 15–16 or 16–17 by inserting peripheral edges of the panel into mortises or grooves 28 provided at appropriate surfaces of the posts 15–17, of the wall sill 11 and of the upper plate 21. The accompanying drawings (FIGS. 2 and 3) only show the mortises or grooves 28 in the posts but it will be appreciated that similar grooves are also provided in the sill and in the upper plate 21. As indicated in FIGS. 2 and 3, when the panels 25 with sandwiched insulation layer 26 is applied, it is preferable to provide a pair of parallel grooves 28 for receiving the edges of the surface members 27 which somewhat extend over the periphery of the sandwiched inner layer. The closeness of the fit of panel edges within the mortise is such as not to be to tight, a "touch" fit within the mortise being ideal. No further stiffeners or frame members touch the panel so that the panel is permitted to flex throughout its whole mass when any cross-diagonal or lateral pressures are exerted upon it, the panel being at the same time held with its edges undistorted. In general, the above state can be defined as one wherein each of said wall panels is maintained in said wall assembly solely by being releasably received with its peripheral edges in grooves provided in side surfaces of two adjacent posts, in the portion of said sill extending between the said posts and in the portion of said upper plate extending between said posts, with the wall panel thus extending between a pair of two adjacent posts, one post of said pair being the outer post the other post of said pair being the inner post, and between said portions of the sill and of the upper plate.

Figure 5:
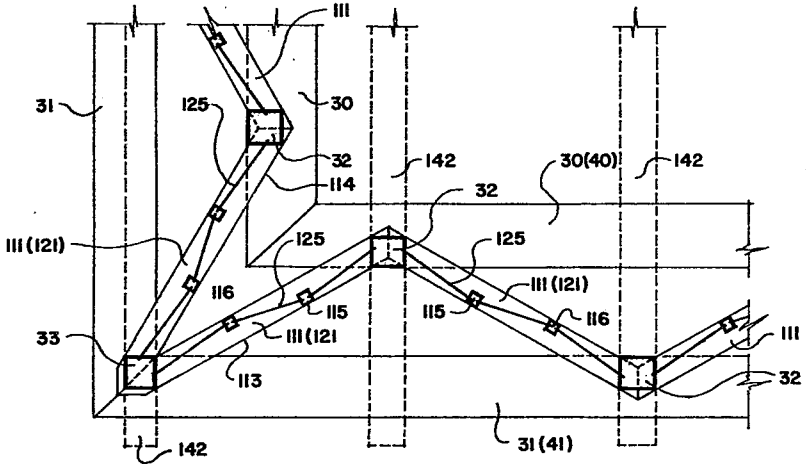
FIG. 5 is a partial plan view similar to that of FIG. 1 but showing another embodiment of the present invention.
Figure 6:
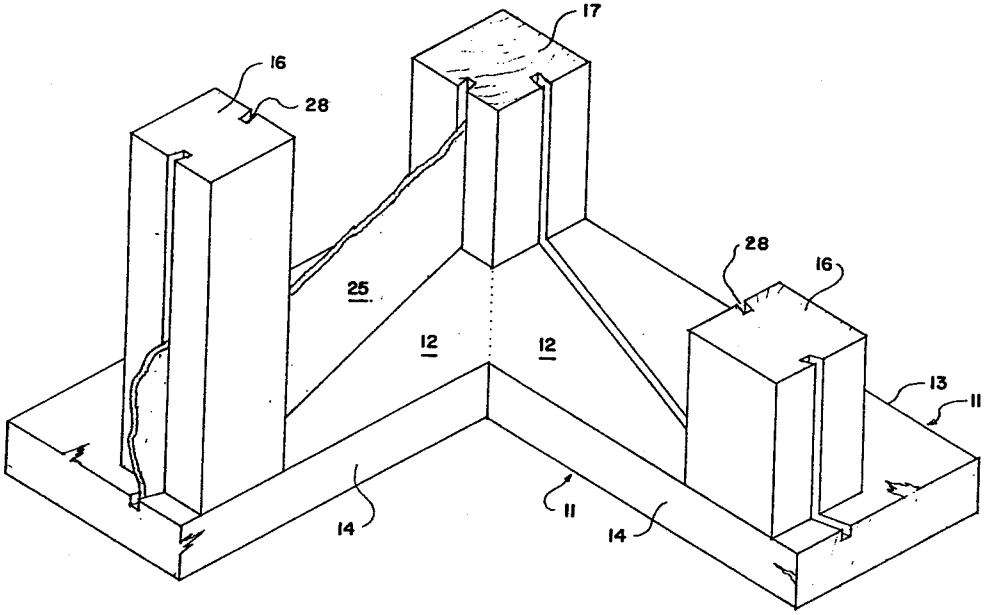
FIG. 6 is a partial perspective view of the embodiment as shown in FIG. 1.

Turning now to FIG. 5, it will be observed that the present invention can also be used in another embodiment which is particularly suitable when a greater stability is required than that of the embodiment of FIG. 1. It will be observed that the modification of FIG. 5 contains the same basic elements as that of FIG. 1 (the corresponding parts being referred to by the same numerals increased by one hundred) but has certain additional features.

Shown in FIG. 5 are two elongated main sills 30, 31 which form main base of this embodiment of the wall assembly.

Positioned on the main sill 30, 31 is a plurality of secondary sills 111 which corresponds to the above mentioned wall sill 11. Thus, the secondary sills 111 also have each an inner and an outer longitudinal substantially vertical surfaces 113, 114. The secondary sills 111 are adapted to be firmly but detachably secured to their associated top portion of the main sills 30, 31 in a known way, e.g. by the above described use of dowels and/or bolts. It is apparent from FIG. 5 that the secondary sills 111 are disposed in a zig-zag fashion.

Main post members 32 including corner posts 33 are fixedly but removably secured to the top of the secondary sills 111 at points of joint between two adjacent secondary sills 111. It can be seen from FIG. 5 that in the shown embodiment such points of joint are alternately located on said main sills 111. The main post members 32 are made of heavy timber and are of generally square cross-section, two sides of the cross-section being generally parallel with longitudinal axis of the wall which, in turn, is generally parallel with the sides of the main sills 30, 33 as shown in FIG. 5.

Intermediate posts 115, 116 of heavy timber of generally square cross-section similar to size to posts 15, 16 of FIG. 1, are secured to the top surfaces of the secondary wall sills 111. Each of the posts 115, 116 thus has four substantially planar vertical surfaces. It can be seen that the disposition of the posts 115, 116 with respect to the associated sills 111 is similar to that of FIG. 1; the distance between the outer surfaces 113 and the inner surfaces 114 (i.e. the width) of the sill 111 is greater than the length of the side of said cross-section of the intermediate posts 115, 116.

Similarly to the embodiment of FIG. 1, the intermediate posts 115, 116 consist of outer post 115 and of inner post 116. It can be seen from FIG. 5 that the outer post 115 are secured with their associated sills 111 so that one of the surfaces of the posts 115 is always generally coincident with the outer surface 113 of the sill 111, while the inner posts 116 have one of their surface generally coincident with the inner surface 114 of sill 111. In view of the above noted width of sill 111 as compared with the length of side of the square cross-section of the posts, it is obvious that the posts are disposed on the sill 111 in a zig-zag fashion.

Secondary upper plates 121 have substantially the same shape as the secondary sills and disposed generally parallel with same (so that they are coincident with the sills 111 as viewed in FIG. 5) are fixedly but detachably secured to the top end of posts 32, 33, 115, 116.

Two elongated main upper plates 40, 41 made of the same heavy timber and disposed parallel with the main sills 30, 31 (so that they appear coincident with sills 30, 31 in top view of FIG. 5) are positioned on top of the upper plates 121 and fixedly but detachably secured to same in the described manner.

The upper plates 40, 41 are arranged to support roof beams 142 and other associated parts of the entire building structure.

Finally, FIG. 5 also shows wall panels 125 which, as shown, are positioned between each part of adjacent posts 33-116-115-32 in the way described above.

Figure 7:
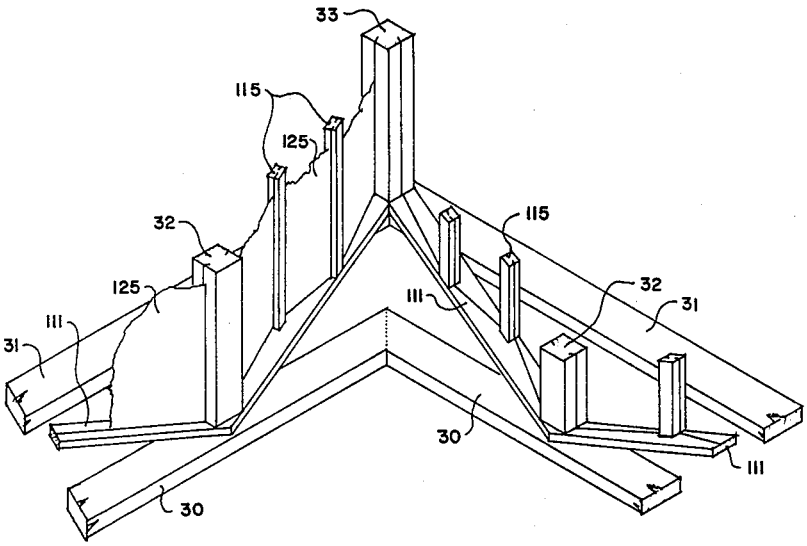
FIG. 7 is a partial perspective view of the embodiment as shown in FIG. 5.
Figure 8:
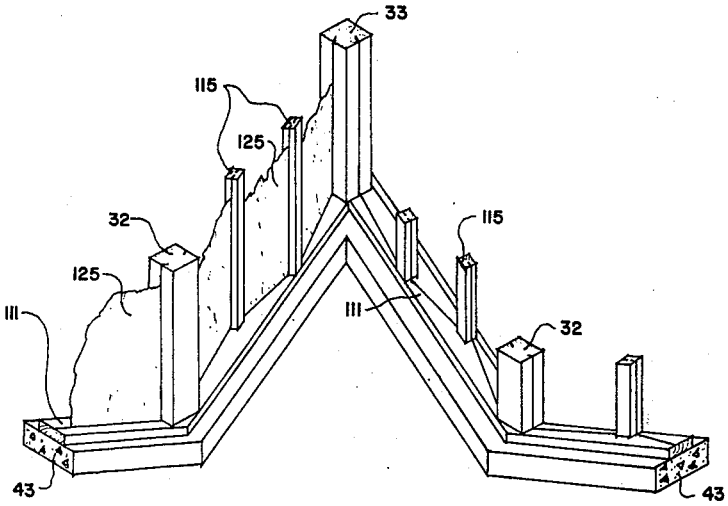
FIG. 8 is still another partial perspective view of a modification of the embodiment shown in FIG. 7.

FIG. 8 shows an embodiment of the present invention which is different from that of FIG. 7 (and thus FIG. 5) in that the main sills are formed by concrete foundation sills 43, 44, on top of which is disposed the wall assembly consisting of the same basic component as in the embodiment of FIGS. 5 and 7.

It will be appreciated that the disclosed embodiments represent examples of the present invention which can be modified to a greater or lesser degree. Thus, various types of known joint members, panel or the like can be employed. However, these and other modifications or additions do not depart from the scope of the present invention as defined in the following claims.

The embodiments of the present invention in which an exclusive property or privilege is claimed are defined as follows:

1. A peripheral wall assembly for a wood frame building, comprising:

a. a substantially horizontal wall sill member including a top, generally horizontal upper surface and longitudinal, generally vertical and inner surfaces parallel with one another, said sill member forming the base of said wall assembly;

b. a plurality of upright posts including corner posts and adapted to be detachably but firmly secured to said top surface of the sill, said posts being heavy timber pieces of rectangular cross section, each of the posts thus having four substantially planar, vertical surfaces;

c. the distance between said two longitudinal surfaces of the sill being greater than the length of sides of said substantially rectangular cross section of the posts;

d. said plurality of upright posts consisting of outer posts and inner posts; said outer posts being secured to said sill with one of their surfaces substantially coincident with said outer surface of said sill, said inner posts being secured to said sill with one of their surfaces substantially coincident with said inner surface, said posts being disposed along said sill in a zig-zag fashion;

e. an upper plate having substantially the same shape as the sill and disposed substantially parallel with same, said posts being adapted to be detachably but firmly secured to said upper plate;

f. substantially planar, rectangular panels; made of fibrous material such as wood;

g. each of said wall panels being maintained in said wall assembly solely by being releasably received with its peripheral edges in grooves provided in side surfaces of two adjacent posts, in the portion of said sill extending between the said posts and in the portion of said upper plate extending between said posts, with the wall panel thus extending between a pair of two adjacent posts, one post of said pair being the outer post, the other post of said pair being the inner post, and between said portions of the sill and of the upper plate.

2. A wall assembly for a wood frame building comprising:

a. at least two elongated main sills forming main base of said wall assembly;

b. a plurality of horizontally extending secondary sills made of heavy timber having outer and inner longitudinal substantially vertical surfaces and adapted to be firmly but detachably secured to the top of said main sills in a zig-zag fashion;

c. upright main post members including corner post members adapted to be fixedly but removably secured to the top of said secondary sill at points of joints between two adjacent secondary sill, said main post members being made of heavy timber and being of a generally cross-section with two opposite sides of said cross-section being generally parallel with longitudinal axis of said wall assembly;

d. at least two upright intermediate post members of generally square cross-section and made of heavy timber pieces, each of the posts thus having four substantially planar vertical surfaces, adapted to be detachably but firmly secured to the top of said secondary sill between each pair of adjacent alternately disposed main post members;

e. the distance between said outer and inner longitudinal surfaces of the secondary sills being greater than the length of longer sides of said generally square cross-section of the intermediate post members;

f. said intermediate posts consisting of outer posts and inner posts, each of said outer posts being secured to its associated secondary sill with one of its surfaces substantially coincident with said outer surface of said sill, each of said inner posts being secured to its associated secondary sill with one of its surfaces substantially coincident with said inner surface, the intermediate posts thus being disposed on said secondary sill in a zig-zag fashion;

g. generally horizontal secondary upper plates having substantially the same shape as the secondary sills and disposed substantially parallel with same, said main and intermediate post members being adapted to be detachably but firmly secured with their upper ends to said upper plates;

h. two elongated, generally horizontal main upper plates disposed in parallel with one another and made of heavy timber, said main upper plate being arranged to be detachably but firmly secured on top of said secondary upper plates;

i. a plurality of substantially planar, rectangular wall panels; made of fibrous material such as wood;

j. each of said wall panels being maintained in said wall assembly solely by being releasably received with its upright peripheral edges in grooves provided in side surfaces of two adjacent post members, horizontal peripheral edges of each of said panels being releasably received in grooves provided in the portions of said secondary sills and said secondary upper plates extending between said two adjacent post members.

3. Assembly as claimed in claim 2, wherein:

a. said main sills are two elongated wall sills made of heavy timber, disposed in parallel with one another and forming main base of said wall assembly;

b. said main post members are disposed alternately on said main sills;

c. said main upper plates are of substantially the same shape as the main sills and are disposed substantially parallel and vertically above same.

4. Assembly as claimed in claim 2 wherein said main sills consists of a plurality of generally straight, elongated concrete foundation sills disposed in a zig-zag fashion generally coincident with that of said secondary sills, said secondary sills being secured to top surface of said concrete sills.

5. Assembly as claimed in claim 1, wherein said upright posts include in their upper end portion means for firmly but detachably securing to said posts generally horizontal roof beams with said upper plate disposed between said upper end portions of said posts and said roof beam.

6. An assembly as claimed in claim 3, wherein said main post members including said corner posts further comprise means in their upper end portion for firmly but detachably securing to said main post members generally horizontal roof beams with said secondary upper plates and with said main upper plates being disposed between said horizontal roof beams and their associated main post members.

7. An assembly as claimed in claim 1, wherein said panels comprise two generally planar surface members and an insulation layer sandwiched therebetween, said panels being releasably received in said grooves by engaging in the grooves peripheral portions of said surface members.

8. An assembly as in claim 3 wherein said panels comprise two generally planar surface members and an insulation layer sandwiched therebetween, said panels being releasably received in said grooves by engaging in the grooves peripheral portions of said surface members.

9. An assembly as in claim 1 wherein said upright posts have horizontal bottom surfaces engaging the horizontal upper surface of said sill and have horizontal top surfaces engaging the lower surface of said plate, and including means detachably but firmly securing said posts to said sill and means detachably but firmly securing said posts to said plate.

10. An assembly as in claim 2 wherein said upright posts have horizontal bottom surfaces engaging the horizontal upper surface of said sill and have horizontal top surfaces engaging the lower surface of said plate, and including means detachably but firmly securing said posts to said sill and means detachably but firmly securing said posts to said plate.

* * * * *